United States Patent [19]

Heberer et al.

[11] Patent Number: 4,911,234

[45] Date of Patent: Mar. 27, 1990

[54] HEAT EXCHANGER COIL WITH RESTRICTED AIRFLOW ACCESSIBILITY

[75] Inventors: Dwight H. Heberer, Plainfield; Avinash N. Patel, Brownsburg; Kevin Torrance, Speedway, all of Ind.

[73] Assignee: Carrier Corporation, Syracuse, N.Y.

[21] Appl. No.: 280,051

[22] Filed: Dec. 5, 1988

[51] Int. Cl.[4] ..... F28F 13/12; F24F 1/02

[52] U.S. Cl. ..... 165/125; 165/48.1; 165/58; 62/259.1; 62/508

[58] Field of Search ..... 65/48.1, 58, 125; 62/507, 508, 259.1

[56] References Cited

U.S. PATENT DOCUMENTS

| | | | |
|---|---|---|---|
| 2,610,484 | 9/1952 | Lange | 165/125 X |
| 4,109,708 | 8/1978 | Imral | 165/48.1 |
| 4,202,409 | 5/1980 | Cann et al. . | |
| 4,203,302 | 5/1980 | Lapeyre | 62/259.1 |
| 4,231,417 | 11/1980 | Ripka . | |
| 4,367,635 | 1/1983 | Leech et al. . | |
| 4,454,641 | 6/1984 | Haas et al. . | |
| 4,519,539 | 5/1985 | Bussjager et al. . | |
| 4,732,012 | 3/1988 | Thorpe | 62/304 |

FOREIGN PATENT DOCUMENTS

| | | | |
|---|---|---|---|
| 61-119937 | 6/1986 | Japan | 165/125 |
| 153175 | 11/1920 | United Kingdom | 165/125 |

*Primary Examiner*—Martin P. Schwadron
*Assistant Examiner*—Allen J. Flanigan
*Attorney, Agent, or Firm*—Dana F. Bigelow

[57] ABSTRACT

An outdoor heat exchanger coil has a fan on one side thereof for forcing ambient air through the coil and a partition on the other side thereof. The partition is placed relatively close to the coil to thereby define a channel which allows the flow of ambient air therethrough without any substantial decrease in system capacity or airflow. A comparison between the channel width and the channel length is made to define the limits of minimal separation between the coil and the partition.

12 Claims, 6 Drawing Sheets

TABLE I

| DISTANCE BETWEEN COIL AND PARTITION (INCHES) | POWER (WATTS) | ERR | SATURATED SUCTION TEMP. (DEG.F) | SATURATED DISCHARGE TEMP. (DEG.F) | SUBCOOLING (DEG.F) | CAPACITY (BTU/HR.) | PERCENT OF FULL CAPACITY |
|---|---|---|---|---|---|---|---|
| NO RESTRICTION | 2852 | 7.9 | 41.32 | 120.3 | 22.0 | 22613 | 100% |
| 6 | 2859 | 7.8 | 41.61 | 120.9 | 21.8 | 22414 | 99.1% |
| 5 | 2852 | 7.9 | 41.5 | 120.6 | 21.6 | 22601 | 99.9% |
| 4 | 2853 | 7.9 | 41.4 | 120.7 | 21.7 | 22561 | 99.6% |
| 3 | 2862 | 7.9 | 41.5 | 121.2 | 21.8 | 22563 | 99.8% |
| 2 | 2863 | 7.7 | 41.5 | 121.3 | 21.9 | 22155 | 98.0% |
| 1 | 2902 | 7.4 | 42.3 | 124.4 | 21.7 | 21479 | 95.0% |
| BLOCKED SIDES | 2911 | 7.3 | 42.5 | 125.2 | 21.8 | 21472 | 95.0% |

FIG. 3A

TABLE III

| DISTANCE BETWEEN COIL AND PARTITION (INCHES) | POWER (WATTS) | ERR | SATURATED SUCTION TEMP. (DEG.F) | SATURATED DISCHARGE TEMP. (DEG.F) | SUBCOOLING (DEG.F) | CAPACITY (BTU/HR.) | PERCENT OF FULL CAPACITY |
|---|---|---|---|---|---|---|---|
| NO RESTRICTION | 4301 | 9.9 | 39.65 | 120.3 | 16.3 | 42462 | 100% |
| 4 | 4285 | 9.9 | 39.25 | 120.1 | 14.8 | 42384 | 99.8% |
| 3 | 4329 | 9.7 | 39.6 | 121.65 | 14.9 | 42085 | 99.1% |
| 2 | 4347 | 9.6 | 39.8 | 122.1 | 14.6 | 41733 | 98.3% |
| 1 | 4362 | 9.5 | 39.95 | 122.8 | 14.4 | 41590 | 97.9% |
| BLOCKED SIDES | 4410 | 9.2 | 40.25 | 125.1 | 11.4 | 40772 | 96.0% |

FIG. 5A

HEAT EXCHANGER COIL WITH RESTRICTED AIRFLOW ACCESSIBILITY

BACKGROUND OF THE INVENTION

This invention relates generally to air conditioning systems and, more particularly, to an outdoor heat exchanger coil structure with an associated panel which limits the accessibility of the airflow to the coil.

Conventional air conditioning systems include both a condenser unit and an evaporator unit, with the condenser unit being located outside and having a heat exchanger coil and an associated fan for blowing ambient air over the coil to thereby dissipate the heat which has bee transferred to the refrigerant during the refrigeration cycle. While the indoor fan is normally driven by a relatively high powered motor to facilitate the proper distribution of air through the ductwork, the outdoor fan is designed for high volume flow at relatively low power. Because of the apparent need to provide for the unrestricted flow of ambient air to the coil, it has become the normal practice to locate the condenser coil in such a position that there is no adjacent structure that would in any way obstruct the free flow of ambient air thereto. The rule of thumb in the industry is to provide at least three feet of clearance around the outer edge of the coil. Thus, the usual practice is to provide a multisided coil surrounding a fan which is axially disposed therein, and with no structure elements located radially outside of the coil except for a grill structure, which presents substantially no restriction to the free flow of air to the coil.

In packaged air conditioning systems of the type which are normally placed on roof tops, both the outdoor and indoor units are placed in the same cabinet, with the two being separated by appropriate partitions or cabinet walls. In addition to the outdoor and indoor coil sections, there are other components such as a compressor, an economizer, etc. which must also be included in the package, thereby further complicating the structure and providing an impediment to the desired unrestricted flow of cooling air describe hereinabove. Further, in some such systems, such as a so called YAC (year-around) unit, there are additional components such as a furnace heat exchanger and an associated combustion system. Because of these requirements, the space for an active coil surface that is unrestricted with regard to airflow thereto, is necessarily limited. But at the same tim,, because of the desirability of obtaining higher efficiencies, it is desirable to increase the size of the effective coil surface. For example, in a system having a three-sided, U-shaped coil, with each of the three sides being unobstructed to airflow an the fourth side being reserved for placement of the compressor unit, it would be desirable to place the compressor within the coil and to add a fourth side to the active portion of the coil. To do so, however, it would be necessary to disassociate the coil from other areas of the unit while, at the same time, not unduly restricting the flow of ambient air to the coil surface.

It is therefore an object of the present invention to provide an improved air conditioning outdoor coil structure.

It is also a function of the present invention to provide a heat exchanger coil structure having a greater effective area but one which is not unduly restricted from the flow of cooling air thereto.

Yet another object of the present invention is the provision in an air conditioning coil structure for more efficiently utilizing the available space in an air conditioning unit.

Yet another object of the present invention is the provision of an air conditioning outdoor unit which is easy and economical to manufacture but which i effective and efficient in operation.

These objects and other features and advantages become more readily apparent upon reference to the following description when taken in conjunction with the appended drawings.

SUMMARY OF THE INVENTION

Briefly, in accordance with one aspect of the invention, an air conditioning outdoor heat exchanger coil is provided with a fan for forcing the ambient air through the coil in heat exchange relationship therewith. Disposed in relatively close proximity to substantial portions of the coil is a wall which, together with the coil, defines a channel through which the cooling air must pass, with the channel having at least one open end that is in airflow communication with the ambient surroundings. The width of the channel as a function of its length is substantially reduced from that of the prior art, but is maintained above a predetermined level to minimize airflow blockage.

In accordance with another aspect of the invention, the ratio of the channel width to channel length is chosen on the basis of experimental results and is preferably greater than 0.3, with the resulting airflow through the coil being substantially equal to a coil structure with no adjacent wall. In this way, efficient use is made of the available space without any substantial change in performance.

By yet another aspect of the invention, where it is possible to give up a slight amount of performance, the ratio of channel width to channel length is chosen to be in the range of 0.14 to 0.3. Although there is some sacrifice in performance when the width is minimized within this range, there is no substantial loss in performance.

In the drawings as hereinafter described, a preferred embodiment is depicted; however, various other modifications and alternate constructions can be made thereto without departing from the true spirit and scope of the invention.

BRIEF DESCRIPTION OF THE DRAWINGS

FIGS. 3A and 3B are respective data and graphic illustrations of system capacity test results in relationship to the distance between the partition and a first coil.

FIGS. 5A and 5B are respective data and graphic illustrations of system capacity test results as a function of the distance between the partition and a second coil.

DESCRIPTION OF THE PREFERRED EMBODIMENT

Figure 1:
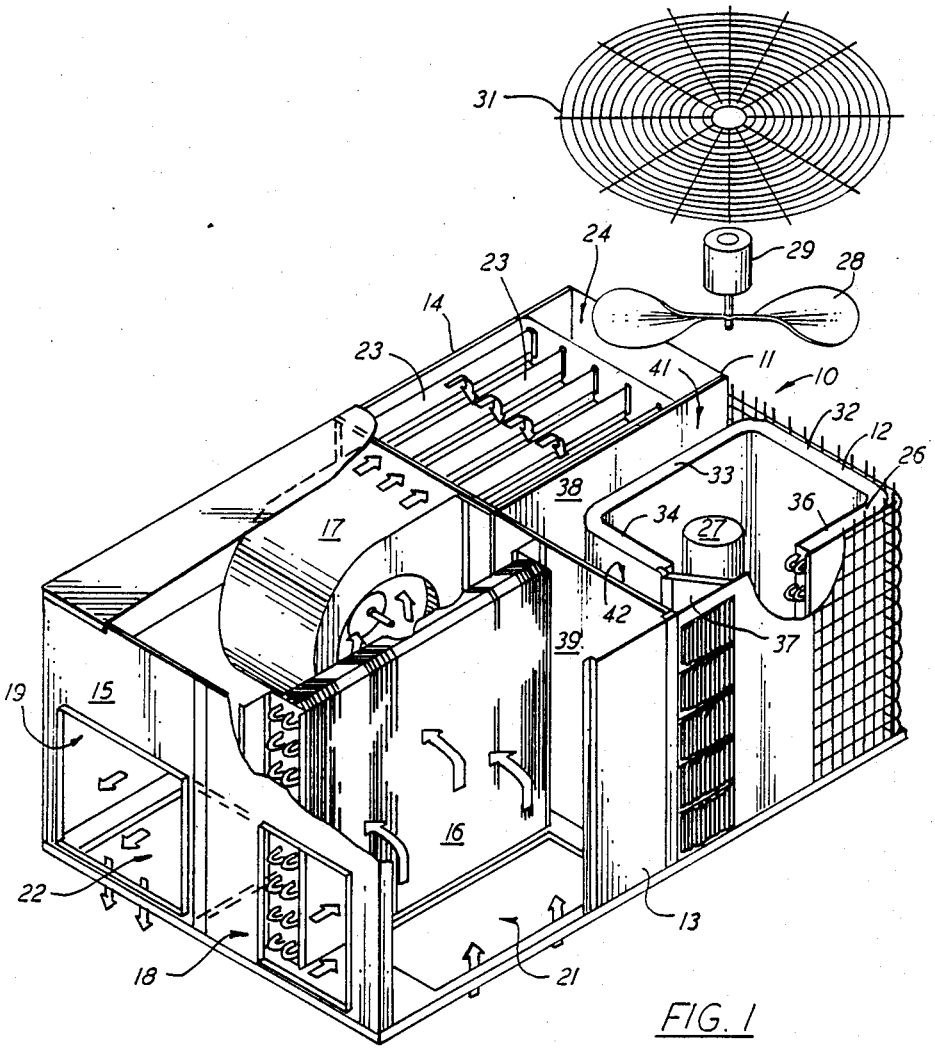
FIG. 1 is a perspective view of a roof top unit with the present invention incorporated therein.

Referring now to FIG. 1, the invention is shown generally at 10 as incorporated into a packaged unit 11 of the type normally located on the rooftop of a building. The unit comprises a condenser section 12, an evaporator section 13, and a heater or furnace section 14, which makes the unit suitable for year-around use.

The evaporator section 13 includes a box-like compartment 15, an evaporator coil 16 mounted transversely therein in such a way as to permit the flow of return air therethrough, and a centrifugal blower 17 mounted adjacent the evaporator coil and adapted to draw the return air through the evaporator coil and to deliver the conditioned air to the ducts to be distributed throughout the building. As will be seen, the unit is designed to accommodate either a down discharge or a side discharge arrangement, with the choice being accommodated by the selective use of covers with the various openings. For example, for a down discharge system, the openings 18 and 19 have covers thereover and the return air comes up through the opening 21, passes through the evaporator coil 16 and into the blower 17 where it is forced downwardly through the furnace section 14, turned 90° to pass under the blower 17 and then is again turned 90° to pass downwardly through the opening 22, where it enters the duct system. Alternatively, covers may be placed over the openings 21 and 22 and the covers removed from the openings 18 and 19 to thereby permit the return air to flow into the opening 18 and the conditioned air to flow in a side discharge manner out the opening 19.

The heater or furnace section 14 includes a heat exchanger 23 and a combustion system 24 (not fully shown). The combustion system 24 includes the typical furnace components, i.e. an inducer motor for drawing combustion air in, a gas valve for regulating the flow of combustion fuel, a plurality of burners for interaction with the various cells of the heat exchanger 23, and a control system for regulating the combustion process. Thus, when furnace heat is called for, the combustion system passes hot gases through the internal structure of the heat exchanger 23, while the blower 17 passes return air over the outer side of the heat exchanger 23 to thereby provide heated air to the duct system.

The condenser section 12 comprises a condenser coil 26, a compressor 27, a fan 28 and associated drive motor 29, and a grill or cover 31. The fan 28 and its drive motor 29 are centrally located near the top of the condenser coil 26 in such a way as to permit the drawing of air radially inwardly through the coil to thereby effect the cooling of the refrigerant within the coil and then to be discharged axially upwardly into the ambient air. The compressor 27 operates in a conventional manner to put energy into the system by the compression of refrigerant in the normal course of a refrigeration cycle.

It should be understood that, while the components of the packaged unit 11 are being described in terms of an air conditioning system with an evaporator coil 16 and a condenser coil 26, if the system is a heat pump operating in a heating mode, then the evaporator coil 16 will be operating as a condenser coil, and the condenser coil 26 will be operating as an evaporator coil. Further, it should be understood that the fan 28 may be operating in the reverse direction to bring air downwardly and then radially outwardly through the coil 26.

The condenser coil 26 is formed with four sides 32, 33, 34, and 36, with sides 32 and 33 extending the entire length of their respective side areas while sides 34 and 36 are each shortened to provide a corner panel 37 that may be removed for purposes of accessing the interior of the condenser coil 26 to conduct maintenance and repair of the system. Both the coil sides 32 and 36 are fully exposed to the ambient air on their outer sides, with no restriction being placed to obstruct the free flow of air to those sides. The coil sides 33 and 34, however, have their respective walls or partitions 38 and 39 placed in relatively close parallel relationship therewith to thereby define the respective channels 4 and 43 through which air must enter in order to pass radially inwardly through those coil sides. The walls 38 and 39 are necessary to isolate the condenser coil 26 from the furnace section 14 and the evaporator section 13, respectively. It should be mentioned that, although the apparatus in FIG. 1 appears to allow for the free flow of air into channels 41 and 42 from the open top area, a cover (not shown) will normally be provided over those channels such that the air must flow into those channels from the side entrance only. It is this structure, i.e. the channels formed by the placement of the partitions 38 and 39 in relatively close relationship with the coil sides 33 and 34, which is the subject of the present invention.

Figure 2:
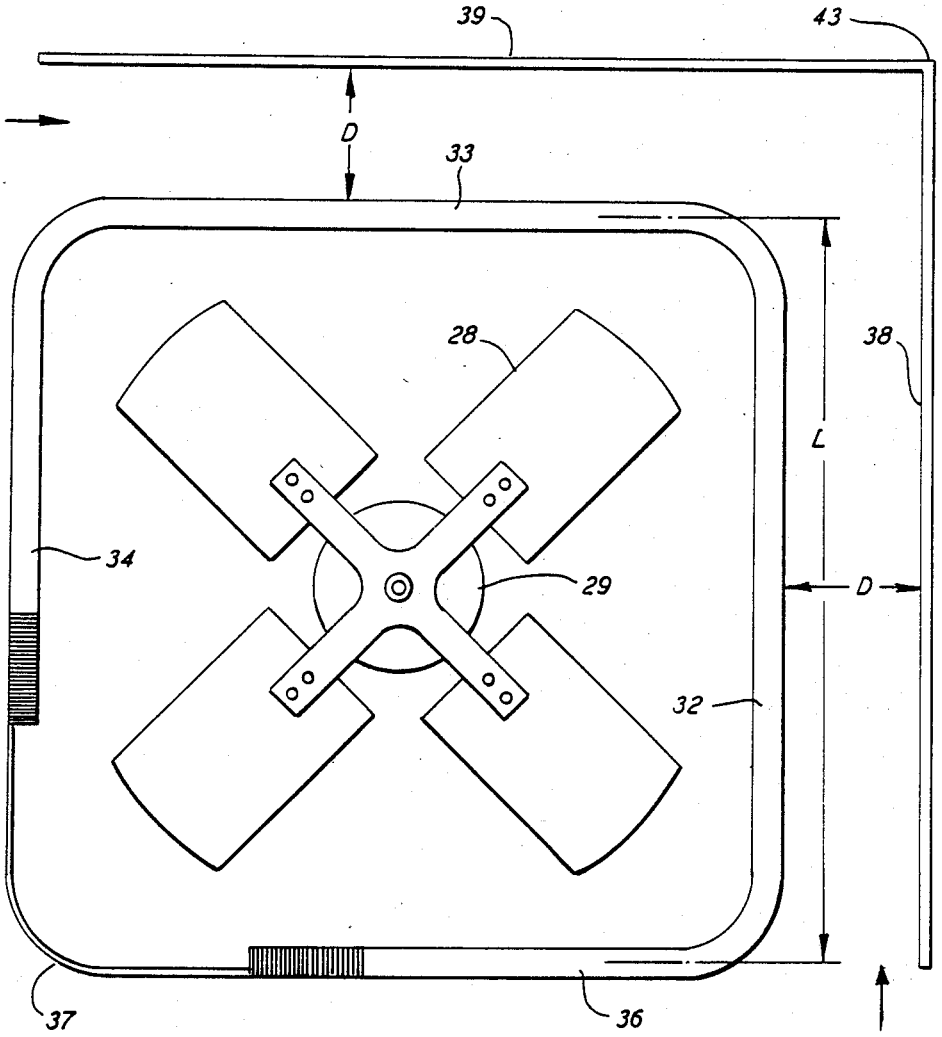
FIG. 2 is a schematic illustration of a test rig which includes a condenser coil and the partition structure adjacent thereto.

Referring now to FIG. 2, there is shown a test setup which was used to determine the effect of placing the partitions 38 and 39 adjacent the coil sides 32 and 33, and to determine how the system capacity and the airflow will vary as the space between those partitions and the adjacent coils (i.e. a distance "D") is varied. The coil and partition arrangement is substantially the same as that shown in FIG. 1 except that the coil has been turned 90° such that the panel 37 is opposite the corner 43 at the interconnection of the partitions 38 and 39, rather than being in the corner adjacent the open end of the coil side 39. Again, a covering structure (not shown) was placed at both the top and the bottom such that air could only enter the channels 41 and 42 by way of the end openings as indicated by the arrows in FIG. 2.

In order to determine the optimum distance, D, between the coil and the solid partitions, a full system (not shown), with an evaporator coil and a compressor, was operated with a condenser unit configuration as shown in FIG. 2. Tests were first run with a coil having a length L equal to 21 inches, and subsequent tests were performed with a coil having length L of 27 inches. In order to establish a base condition, the system was first run without any partitions in place such that the flow of air to the coil was unrestricted. The same test was then run several times with the partition being placed at various distances from the coil, an measurements were taken at each setting to calculate the system capacity. The results of the test for the 21 inch coil are shown in Table I of FIG. 3A. It will be seen that, as the partition is moved closer to the coil, the capacity is gradually decreased from 100 percent of full capacity to 95 percent of full capacity. The final testing position, indicated by "blocked sides," was conducted by actually placing the partition against the otter side of the coil such that there was no air flowing radially inwardly through those two sides of the coil. It should be recognized that under this condition, the other coil sides 34 and 36 would have more than the usual amount of air flowing therethrough and coils 32 and 33 would still be somewhat effective because of the cooling effect of the air on their inner sides. It should also be recognized that the heat transfer relationship at the coil is in accordance with the well known equation:

$$Q = K \times CFM \times \Delta T \qquad \text{Eq. (1)}$$

wherein

Q=heat transfer in btu/hr
K=a constant
CFM=airflow in $ft^3$/min
$\Delta T$=temperature gradient Thus, as the volume of airflow is decreased over certain portions of the coil, the temperature of the refrigerant therein is also increased to thereby increase the $\Delta T$. Accordingly, the system is somewhat self-correcting in this regard.

Figure 3B:
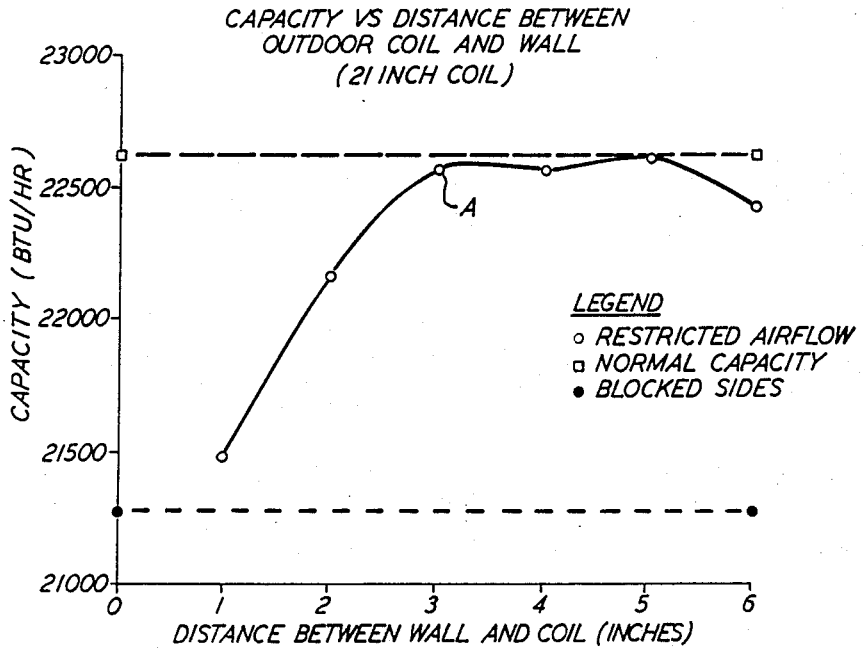

A graphic representation of the data in FIG. 3A is shown in FIG. 3B. From the graph it will b seen that the capacity is gradually reduced as the partition is moved inwardly. At point A, where the distance D is decreased below 3 inches, the slope of the curve becomes more dramatic such that the capacity decrease for a given distance change is greater than for the range above point A. At the 1 inch distance the capacity is reduced to 95 percent of full capacity.

Considering now the total airflow through the system as it is affected by the movement of the wall toward the coil, tests were again conducted with the test rig of FIG. 2, with the airflow being measured in cubic feet per minute (CFM). This was accomplished by the use of a plenum located over the fan discharge area and with a calibrated nozzle for measuring the pressure drop thereacross, which, in turn, can be used in a conventional manner to calculate the total airflow in the system.

A measurement was first taken with no partition in place to establish a base line of 2312 CFM as 100 percent airflow volume. The partition was then moved to various distances and the associated airflow volume were measured. The results are shown in the following table.

TABLE II

| DISTANCE BETWEEN COIL AND PARTITION (INCHES) | AIRFLOW (CFM) | PERCENT OF FULL AIRFLOW |
|---|---|---|
| NO PARTITION | 2312 | 100% |
| 1 | 2203 | 95% |
| 2 | 2248 | 97% |
| 3 | 2280 | 98.6% |
| 4 | 2280 | 98.6% |
| 5 | 2301 | 99.5% |

COIL DIMENSIONS: 21 × 21 × 26"
FINS-PER-INCH: 25
BLADE DIAMETER: 18

Figure 4:
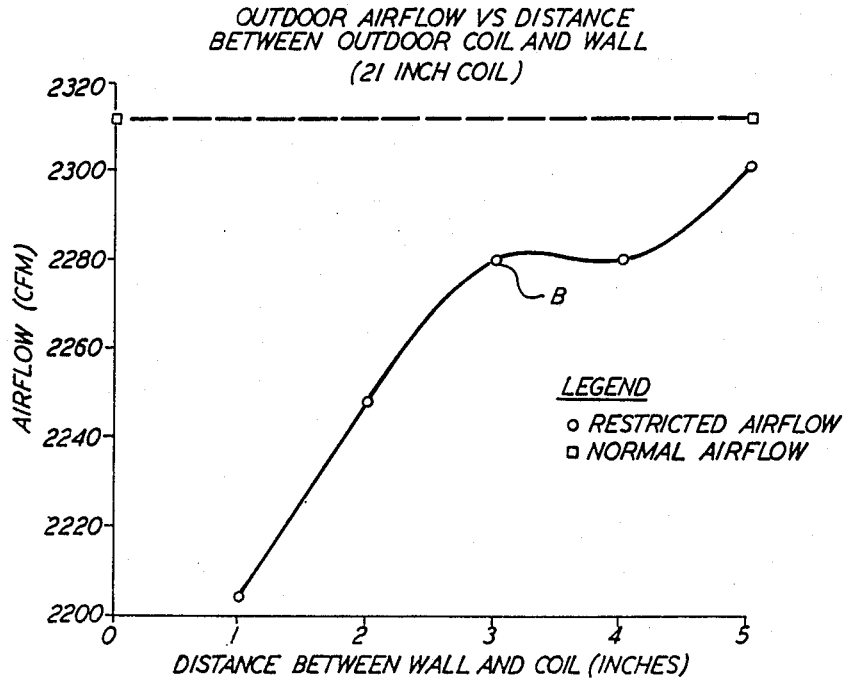
FIG. 4 is a graphic illustration of test results showing the airflow through the coil as a function of the distance between the partition and the coil.

The data from Table II is graphically illustrated in FIG. 4. From the graph, it will be seen that, consistent with the graph of FIG. 3B, the curve is relatively flat as the wall is moved to the 3 inch position (point B) but then it fall rather dramatically from that point inwardly.

From the above results, two conclusions can be made. Firstly, the relatively large distances (i.e. 3 feet) that have heretofore been prescribed for the placement of obstructions, such as walls and the like, from the outer side of the condenser coil, are not necessary. That is, a partition may be placed within 5-6 inches of the coil outer surface with little or no effect on the air flowing through the coil or the capacity of the system. Secondly, as the distance is decreased below 5-6 inches, there is a transition point where the effect of the wall's presence on the airflow through the coil is proportionately increased such that for a given movement of the wall, the associated change in airflow through the coil is greater below that point than above it. In the above conducted tests, that transition point was found to be at a point of three inches from the coil.

When considering the geometry of the coil test arrangement as shown in FIG. 2, it will be recognized that, with respect to airflow requirements, there is a direct relationship between the width of the channel, D, and the length L thereof. That is, as the length L is increased, so too must the width D be increased in order to accommodate the same airflow rate through a given length of the coil. Given this relationship then, the transition point in the two above described curves can be identified with a particular D/L ratio. That is, where the channel width is 3 inches and the length of the coil is 21 inches, the D/L ratio at the transition point is 0.143.

In addition to the 21 inch coil described hereinabove, the same tests were conducted with a 27 inch coil (i.e. 27 in.×X27 in. on each side). The results of the tests wherein system capacity was measured are provided in the Table III of FIG. 5A. There it will be seen that the capacity of the system was decreased from 100 percent to 96 percent as the wall was moved inwardly toward the coil outer surface.

Figure 5B:
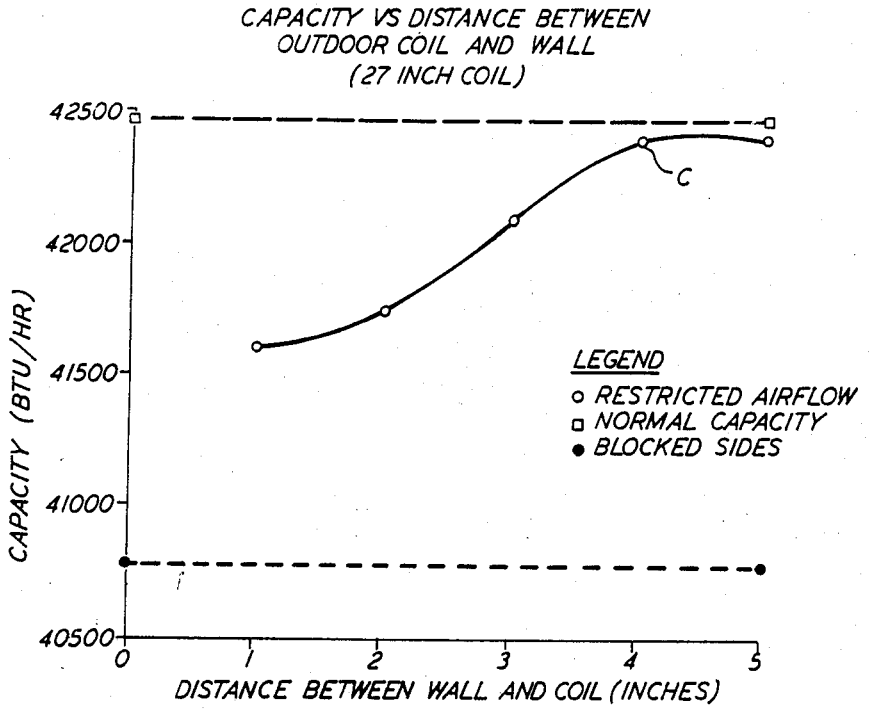

Referring now to FIG. 5B, the data of FIG. 5A is graphically illustrated. Here it will be seen that the curve is relatively flat as the distance is decreased down to 4 inches, then at point C a transition occurs wherein the slope becomes more pronounced.

The 27 inch coil was also tested with regard to its airflow characteristics with changes in the distance D, and the results were found to be as follows:

TABLE IV

AIRFLOW VS. DISTANCE

| DISTANCE BETWEEN COIL AND PARTITION (INCHES) | AIRFLOW (CFM) | PERCENT OF FULL AIRFLOW |
|---|---|---|
| NO PARTITION | 3488 | 100% |
| 2 | 3077 | 88% |
| 3 | 3194 | 92% |
| 4 | 3262 | 93.5% |
| 5 | 3270 | 93.8% |
| 6 | 3311 | 94.9% |

COIL DIMENSIONS: 27 × 27 × 26"
FINS-PER-INCH: 25
BLADE DIAMETER: 20

Figure 6:
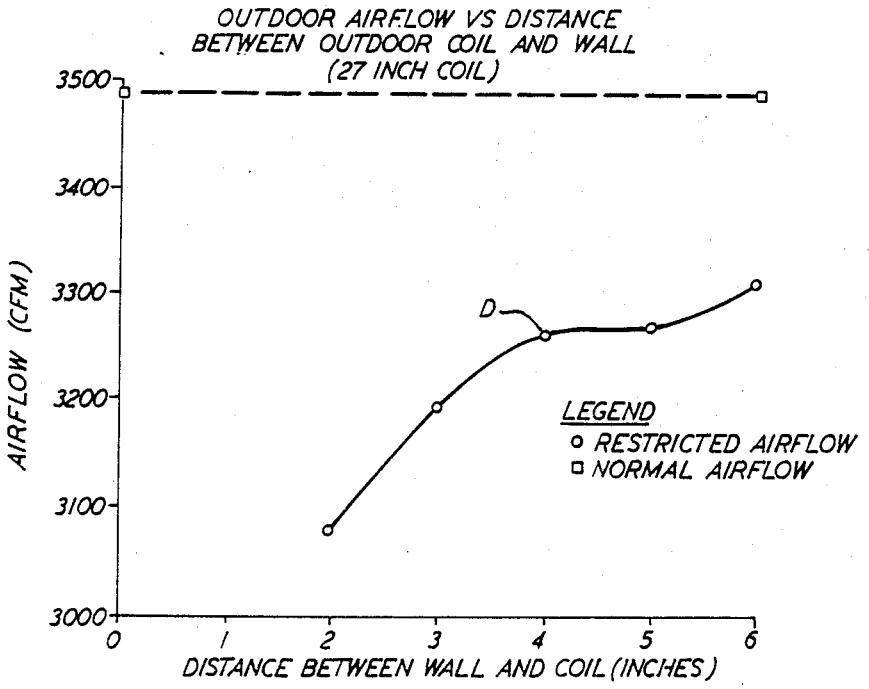
FIG. 6 is a graphic illustration of test results showing the airflow through the second coil as a function of the distance between the partition and the coil.

The data of Table IV is shown graphically in FIG. 6. Again, it will be seen that in the range above 4 inches distance, the curve is relatively flat, but at point D it transitions to a substantially steeper curve such that a given change in the dimension D results in greater proportionate changes in airflow volumes.

Equating now the above results with a particular D/L ratio, the transition point for the 27 inch coil was found to be 4/27=0.148. This is consistent with the results obtained with the 21 inch coil.

The results with the 27 inch coil is also consistent with the other conclusion as drawn above, i.e. that a wall or partition may be moved within 5-6 inches of the coil without any depreciable decrease in system capacity. Equating the distances with the coil length as we did above, we find that for the 21 inch coil, the D/L ratios at the outermost test point, where there was substantially no loss in capacity, we have D/L=5/21=0.24. Similarly, for the 27 inch coil the D/L ratio is 5/27=0.286. It can therefore be concluded that, with the wall in positions wherein the D/L ratio is greater than 0.3, there will be little or no reduction in system capacity caused by the presence of the wall. It can also be concluded that, with a typical air conditioning system, it is possible to place a wall relatively close to the outer surface of a condenser coil without any appreciable affect on system performance, and that a distance of 12 inches is well within the range of possible positions meeting this criteria.

While the present invention has been disclosed with particular reference to a preferred embodiment, the concepts of this invention are readily adaptable to other embodiment, and those skilled in the art may vary the structure thereof without departing from the essential spirit of the invention.

What is claimed is:

1. In the air conditioning system having an outdoor heat exchanger coil, an associated fan for forcing the flow of ambient air between adjacent tubes therein, and an enclosing housing containing said coil and said fan, a wall structure comprising:

a partition contained within said housing and disposed on the opposite side of said coil from the fan, said partition being in substantial parallel relationship with a substantial portion of the coil and forming therewith an elongated channel having a length, a width and an open end in direct fluid communication with the space exterior to said housing for conducting the flow of air along its length between the edges of said partition and central portions thereof to facilitate the passing of ambient air through the coil, the channel width as defined by the distance between said partition and said coil being less than 12 inches.

2. A wall structure as set forth in claim 1 wherein said fan is substantially enclosed by said heat exchanger coil and further wherein said fan draws the ambient air radially inwardly therethrough from the channel.

3. A wall structure as set forth in claim 1 wherein said partition is sized and located such that the ratio of the width of said channel to the length thereof is greater than 0.3.

4. A wall structure as set forth in claim 1 wherein said partition is sized and located such that the ratio of the width of said channel to the length thereof is smaller than 0.3 but greater than 0.1.

5. A wall structure as set forth in claim 2 wherein said channel is open to the inflow of air at only said open end thereof and not at the top or bottom thereof.

6. A wall structure as set forth in claim 5 wherein a portion of said coil is L-shaped in form and said partition is also L-shaped in form.

7. An improved air conditioning outdoor heat exchanger structure comprising:

a plurality of tubes aligned in substantial parallel spaced relationship to define a coil having an air entrance side and an air exit side;

a fan for circulating air from said air entrance side through the spaces between said tubes and out said air exit side; an enclosing housing containing said coil and said fan; and a wall contained within said housing and disposed in substantial parallel relationship with a substantial portion of one of said sides to form, with said substantial portion, an elongate channel having a length and a width and an open end in direct fluid communication with the space exterior to said housing to conduct the flow of air along its length to pass through said coil, the channel width as defined by the distance between said wall and said coil being less that 12 inches.

8. An improved heat exchanger structure as set forth in claim 7 wherein said fan is on one side of said coil and said wall is on the other side thereof.

9. An improved heat exchanger as set forth in claim 8 wherein said fan is substantially enclosed by said coil and further wherein said fan operates to draw the ambient air in through said channel and then through said coil.

10. An improved heat exchanger as set forth in claim 7 wherein said wall is sized and located such that the ratio of the width of said channel to the length thereof is greater that 0.3.

11. An improved heat exchanger structure as set forth in claim 7 wherein said wall is sized and located such that the ratio of the width of said channel to the length thereof is less than 0.3 but greater than 0.1.

12. An improved heat exchanger structure as set forth in claim 7 wherein a portion of said coil is L-shaped in form and said wall is also L-shaped in form.

* * * * *